US006616425B2

(12) United States Patent
Kober

(10) Patent No.: US 6,616,425 B2
(45) Date of Patent: Sep. 9, 2003

(54) FEED DEVICE FOR A MOTOR VEHICLE AND RESERVOIR FOR A FEED DEVICE

(75) Inventor: Rainer Kober, Darmstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/006,988

(22) Filed: Dec. 4, 2001

(65) Prior Publication Data

US 2002/0085934 A1 Jul. 4, 2002

(30) Foreign Application Priority Data

Dec. 8, 2000 (DE) ..... 100 61 013

(51) Int. Cl.[7] ..... F04B 17/00; H02K 5/10

(52) U.S. Cl. ..... 417/423.14; 417/414; 417/412; 417/423.19; 310/88

(58) Field of Search ..... 417/414, 421, 417/423.1, 423.9, 423.11, 423.14; 310/88, 77; 222/383.1

(56) References Cited

U.S. PATENT DOCUMENTS 3,308,762 A * 3/1967 Fricker ..... 417/421
4,544,166 A * 10/1985 Karasawa ..... 310/88
4,893,039 A * 1/1990 Isii ..... 310/89
4,919,591 A 4/1990 Kamimura et al.
6,053,708 A * 4/2000 Nishikawa ..... 417/360
6,109,891 A * 8/2000 Sato ..... 417/423.14

FOREIGN PATENT DOCUMENTS

| | | |
|---|---|---|
| DE | 4128535 | 3/1993 |
| DE | 4412210 | 12/1994 |
| DE | 19846755 | 4/1999 |
| DE | 19753457 | 6/1999 |
| DE | 19959976 | 6/2000 |

OTHER PUBLICATIONS

Patent Abstracts of Japan, 63151560, Jun. 24, 1988, Toshiyuki, Jidosha Denki Kogyo Co Ltd.

* cited by examiner

*Primary Examiner*—Charles G. Freay
*Assistant Examiner*—Timothy P. Solak
(74) *Attorney, Agent, or Firm*—Martin A. Farber

(57) ABSTRACT

A feed device (1) for washer fluid, wherein an electric motor (3) which is provided for driving a feed pump (4) has a housing (6) which is sealed in the upper region and an opening (11) which is arranged in the lower region level with the feed pump (4). Ventilation of the electric motor (3) takes place via this opening (11). In the event of a water level reaching the electric motor (3), for example if the motor vehicle passes through water, an air bubble is formed in the housing (6), the air bubble preventing water from penetrating into the electric motor (3).

19 Claims, 3 Drawing Sheets

8
29
3
22
23
26
30
27
28
25
24
4

14
15
3
16
19
17
18
4
8
21
20

10
13
12
11
8
9
7
1
3
6
4
5
2

FEED DEVICE FOR A MOTOR VEHICLE AND RESERVOIR FOR A FEED DEVICE

FIELD AND BACKGROUND OF THE INVENTION

The invention relates to a feed device for a motor vehicle for feeding washer fluid from a reservoir to a washer jet arranged in front of a window or lens, having a feed pump which is driven by an electric motor and having a ventilating means for the electric motor. Furthermore, the invention relates to a reservoir for a feed device provided for feeding washer fluid to motor-vehicle washer jets arranged in front of a window or lens, the feed device having a feed pump which is driven by an electric motor and a housing having a ventilating device for the electric motor.

Feed devices of this type together with the associated reservoir are frequently used in motor vehicles today and are known from practice. The ventilating means generally has a recess which is arranged in the housing and through which air can flow into and out of the electric motor without hindrance. Since the reservoir for the washer fluid together with the feed devices arranged thereon is generally arranged at a very low point in the motor vehicle, during passage through water the feed devices are flooded by the water. In the process, water can penetrate through the ventilating means into the electric motor and can damage the latter. However, it is not expedient to completely seal the housing of the electric motor, since condensation water forming in the housing has to be removed. Otherwise, the electric motor becomes corroded by the condensation water.

SUMMARY OF THE INVENTION

The invention is based on the problem of designing a feed device of the type mentioned at the beginning in such a manner that it as reliably as possible prevents water from penetrating into the electric motor when the motor vehicle passes through water. Furthermore, a reservoir of the type mentioned at the beginning is to be designed in such a manner that it prevents water from penetrating into the electric motor.

According to the invention, the problem mentioned first is solved by means for forming an air bubble within the electric motor in the event of a water level reaching the electric motor in its designated installation position.

This design of the electric motor enables an air bubble to be trapped within the housing in the event of a high water level. This air bubble prevents water from penetrating into the housing and therefore prevents damage to the electric motor. At a low water level, the housing is ventilated via the ventilating device as in the case of the known feed device. The invention reliably protects the electric motor from corrosion not only when passing through water, but also during engine washing or during intense inspections of the protective system. Since passage of the motor vehicle through water is frequently restricted to a designated period of time, it is frequently sufficient to retard the penetration of water and therefore to ensure the formation of the air bubble for a designated period of time.

According to an advantageous development of the invention, the air bubble in the housing can be produced in a simple manner if the ventilating means has an opening which points downward in the designated installation position of the electric motor, and if the housing is designed such that it is hermetically sealed in the upper region. This enables air to be exchanged by the electric motor with the surroundings via the downwardly pointing opening. However, water cannot penetrate through the opening, since the air contained in the electric motor cannot escape.

According to another advantageous development of the invention, a further option for producing the air bubble resides in the fact that the opening can be closed by means of a valve and channels or gaps present in the remaining region of the housing do not exceed a designated cross section. By means of this design, complicated sealing of the upper region of the housing is not required, since water cannot penetrate into the electric motor, at least for a long period, via relatively small channels which are present, for example, in the case of multiwire electric lines or in the case of press fits. In the most favorable case, with the installation of an additional component the known feed device can thereby be sealed in a simple manner against water penetrating.

According to another advantageous development of the invention, the housing can be reliably sealed with a particularly low outlay if the lower edge of a cap arranged on the upper side of the electric motor is arranged level with the opening.

The feed device according to the invention can be manufactured particularly cost effectively if the cap forms a subregion of the opening.

The installation of the feed device according to the invention turns out to be particularly simple if the housing of the electric motor has a channel guided up to the opening.

According to another advantageous development of the invention, entry of spray water into the housing of the electric motor can be avoided in a simple manner if a recess is arranged in the housing of the electric motor on the opposite side of the opening and if the recess and the opening are connected to each other via the channel.

According to another advantageous development of the invention, an escape of air between the housing and the cap can be avoided in a simple manner if the cap is sealed with respect to the housing of the electric motor.

The feed devices are supplied with electric current via electric lines. In this case, it has been established that the air can escape from the housing through the strands of the electric lines, which strands comprise a plurality of individual wires. According to another advantageous development of the invention, an escape of air through the electric lines can be avoided in a simple manner if contacts which are arranged on the upper side of the electric motor and are provided for the connection of electric lines are sealed with respect to the cap or the housing. This prevents air from the electric motor from penetrating as far as the electric lines, with the result that the type of lines connected to the contacts is irrelevant to the sealing of the electric motor.

According to an advantageous development of the invention, the sealing of the contacts turns out to be particularly simple in structural terms if the cap has a seal manufactured from an elastomeric material, and if the seal bears tightly against the contacts. The seal preferably bears against the inside of the cap.

According to another advantageous development of the invention, a housing of the known feed device, which housing is sufficiently sealed in the upper region, can be sealed in a simple manner against water penetrating if the housing is connected in the region of its recess, which is provided for ventilation purposes, in a sealing manner to an elastic, annular element or partially annular element, and if the element has a channel with the opening.

According to another advantageous development of the invention, entry of spray water into the electric motor is further avoided if the annular element covers an annular groove arranged on the outside of the housing of the electric motor in the region of the recess provided for ventilating purposes, and if the channel is connected to the annular groove.

The channel could be guided in an angular manner around the feed pump. The manufacturing costs of the feed unit according to the invention are further reduced if the channel is inclined by a designated angle with respect to the axis of symmetry of the electric motor.

According to another advantageous development of the invention, the channel has sufficient intrinsic stability if it has an encircling collar at its free end.

According to another advantageous development of the invention, a particularly small structural outlay is required in order to avoid water from penetrating through the opening if a valve controlled by a float is arranged on the opening or in the channel connected to the opening.

According to another advantageous development of the invention, penetration of spray water through the opening into the electric motor can be avoided in a simple manner if the opening is arranged on a side of the electric motor that is to face the reservoir. The opening is thereby protected by the reservoir. If the float is arranged in the region of the opening, movement thereof by spray water is also prevented and if the reservoir is installed in the engine compartment of the motor vehicle, damage thereto, for example during engine washing, is prevented.

The feed device according to the invention turns out to be particularly compact if a housing of the feed pump to be arranged below the electric motor has a subregion of the channel guided to the opening.

According to another advantageous development of the invention, the valve turns out to be particularly simple in terms of structure if a valve body of the valve which is designed as a float is mounted pivotably.

The problem mentioned second, namely the provision of a reservoir of the type mentioned at the beginning for preventing water from penetrating into the electric motor is solved according to the invention in that the reservoir has an edge which fits over the electric motor and is guided at least to the lower side of the housing. By means of this design, the air bubble protecting the electric motor from water penetrating is produced by the reservoir. This design does not therefore require any change to the structure of the electric motor.

BRIEF DESCRIPTION OF THE DRAWINGS

The invention permits numerous embodiments. To further clarify its basic principle a number thereof are illustrated in the drawing and will be described below. In the drawing

DETAILED DESCRIPTION OF THE PREFERRED EMBODIMENT

Figures 1, 2, 3:
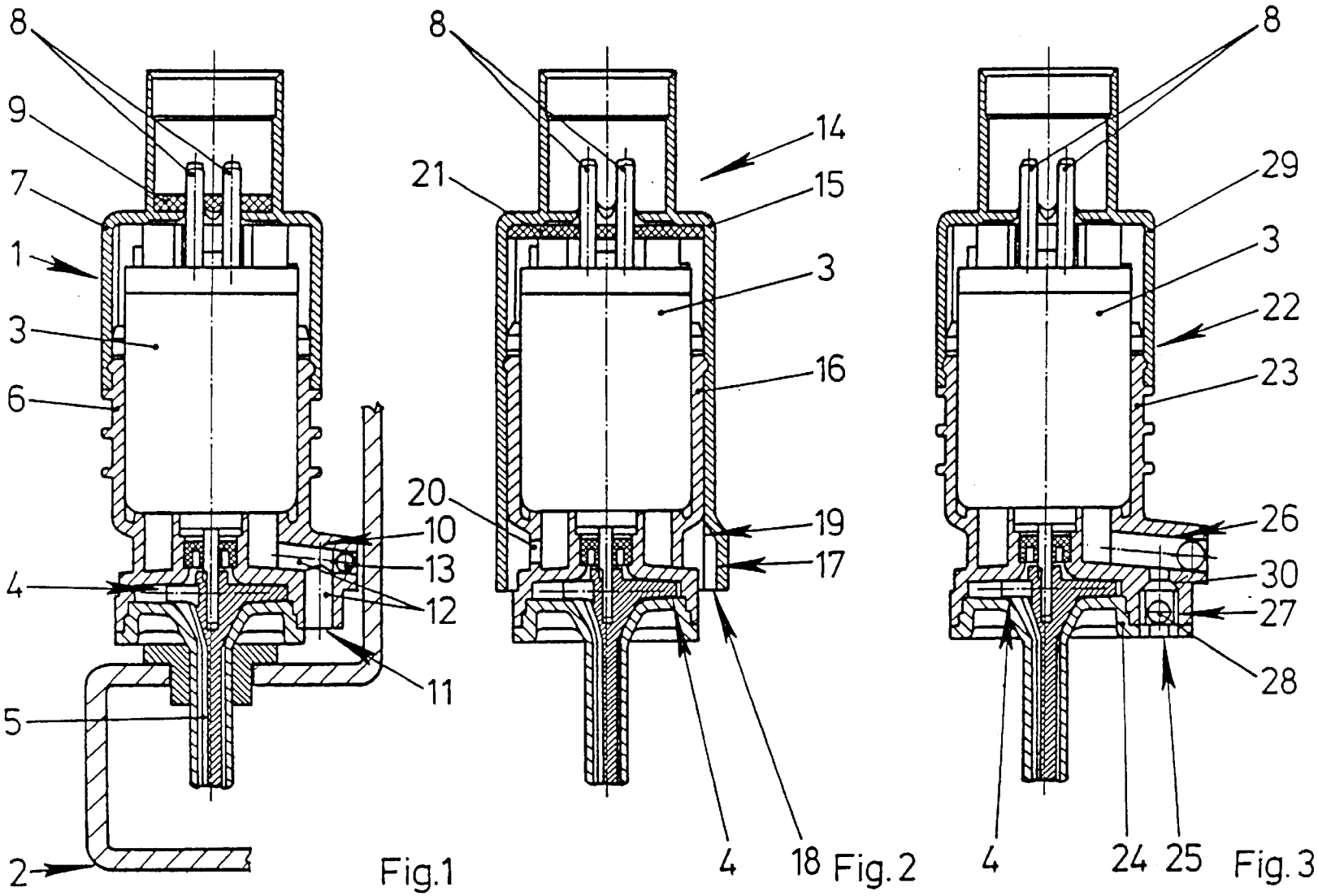
FIG. 1 shows a feed device according to the invention having a channel arranged in a housing of an electric motor.
FIG. 2 shows a feed device according to the invention having a cap guided into the region of a feed pump.
FIG. 3 shows a feed device according to the invention having a channel guided through a housing of the feed pump.

FIG. 1 shows a sectional illustration through a feed device 1 for feeding washer fluid from a reservoir 2 to motor-vehicle washer jets (not illustrated). The feed device 1 has a feed pump 4 which is driven by an electric motor 3. The feed pump 4 has an intake channel 5, which protrudes into the reservoir 2, and a connection (not illustrated) which projects into the plane of projection and is intended for a washer fluid line leading to the washer jets. The electric motor 3 has a housing 6 and a cap 7 which closes the upper side of the housing 6. Contacts 8 of the electric motor 3, which contacts are provided for the connection of electric lines, are guided through the cap 7. A seal 9 is arranged on the outside of the cap 7 in the region of the contacts 8. A plug having electric lines can be connected to the contacts 8 for the purpose of supplying the electric motor 3 with electric current. The seal 9 consists of an elastic material and seals the cap 7 with respect to the contacts 8. The cap 7 is sealed with respect to the housing 6, for example by an adhesive bond, so that air situated within the housing 6 of the electric motor 3 cannot escape upward. The housing 6 has a channel 10 which is guided laterally past the feed pump 4 and has an opening 11 arranged level with the feed pump 4. The channel 10 is formed by two holes 12 arranged in the housing 6, one free end of one of the holes 12 being tightly closed by a pressed in ball 13. The electric motor 3 exchanges air with the surroundings via the channel 10 and the opening 11. Condensation water which accumulates within the electric motor 3 can therefore escape. The opening 11 is also arranged on that side of the feed device 1 which faces the wall of the reservoir 2 and is therefore protected from penetration of spray water. In the event of a water level rising above the feed device 1, for example if the motor vehicle having the feed device passes through water, water cannot penetrate into the electric motor 3, since air within the housing 6 cannot escape. By this means, even if the feed device 1 stands for a prolonged period under water, an air bubble is formed which protects the electric motor 3 from being filled with water and therefore protects it from corrosion.

FIG. 2 shows a feed device 14 in which a lower boundary of a cap 15 of the electric motor 3 is arranged level with the feed pump 4. The cap 15 forms, together with the outer wall of a housing 16 of the electric motor 3, a channel 17 having an opening 18 arranged level with the feed pump 4. The housing 16 has a recess 20 arranged in an annular groove 19. This recess 20 is arranged on the opposite side of the channel 17. The electric motor 3 is therefore ventilated via the recess 20 in the housing 16, in the annular groove 19 and in the channel 17 formed by the cap 15. In comparison to the feed device 1 from FIG. 1 the cap 15 does not therefore need to be sealed with respect to the housing 16. A seal 21 for sealing the cap 15 with respect to the contacts 8 is arranged on the inside of the cap 15.

FIG. 3 has a feed device 22 having a channel 26 which is guided through a housing 23 of the electric motor 3 and through a housing 24 of the feed pump 4 as far as an opening 25 arranged on the lower side of the feed pump 4. This feed device 22 differs from the one from FIG. 1 in that a valve 27 having a float 28 is arranged in the channel 26 and in that a cap 29 is pressed on with respect to the contacts 8 and the housing 23 of the electric motor 3. A valve seat 30 of the valve 27 is arranged on the housing 23 of the electric motor 3. The float 28 is designed as the valve body and is guided by the housings 23, 24 of the electric motor 3 and of the feed pump 4. In the position shown, the valve 27 is open, so that air can be exchanged between the electric motor 3 and the surroundings. In the event of water penetrating into the channel 26, the float 28 is pressed against the valve seat 30 and therefore closes the channel 26. Water cannot therefore penetrate into the interior of the electric motor 3. In this case, capillary channels may be present between the cap 29 and the contacts 8 or the housing 23 of the electric motor 3 as long as these channels do not exceed a designated cross section. Therefore, in contrast to what is illustrated in FIGS. 1 and 2, this feed device 22 does not need a complicated sealing of the cap 29.

Figure 4:
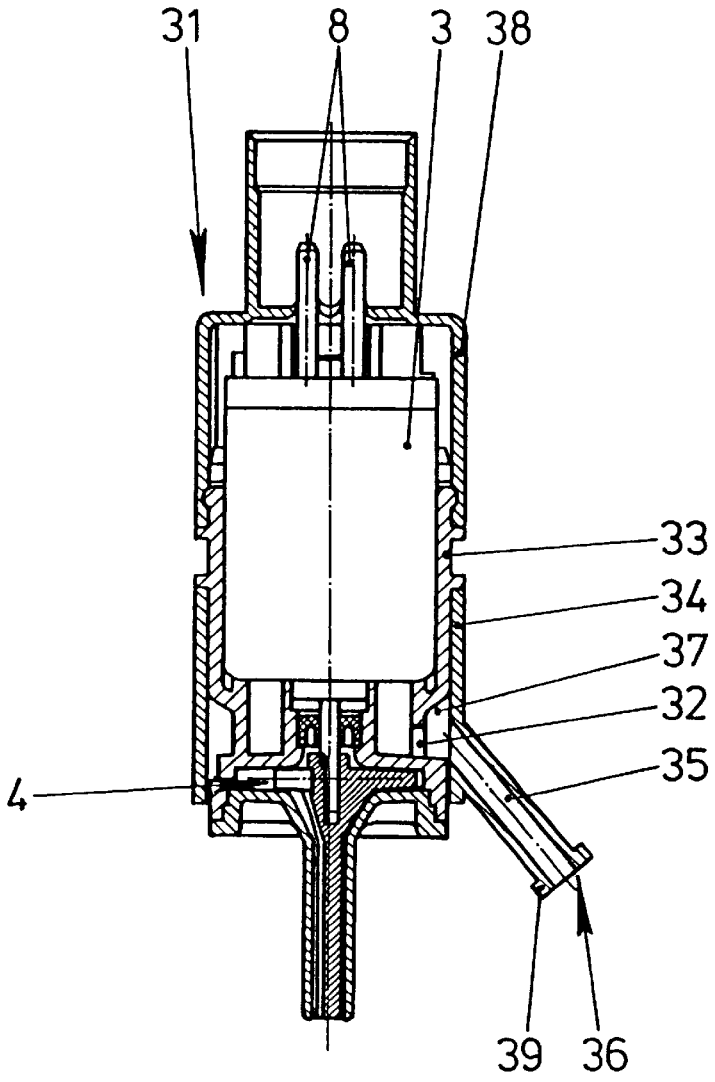
FIG. 4 shows a feed device according to the invention having a channel arranged on an elastic, annular element.

FIG. 4 shows a feed device 31 in which an annular element 34 of elastic design is arranged in a sealing manner in the region of a recess 32 in a housing 33 of the electric motor 3. The annular element 34 has a channel 35 having an opening 36 arranged below the feed pump 4. The channel 35 opens into the region of an annular groove 37, which is arranged in the housing 33, directly in front of the recess 32 provided for ventilating the electric motor 3. The design of the housing 33 of the electric motor 3 corresponds to that which is known from practice, a cap 38 which closes the upper side of the housing 33 being sealed with respect to adjacent components. This design of the feed device 31 therefore has the advantage of enabling existing feed devices to be retrofitted, so that the electric motor 3 is not filled with water. Of course, as in the case of the feed device 22 from FIG. 3, the channel 35 may also open into the annular groove 37 in the opposite region of the recess 32. The channel 35 has an encircling collar 39 at its free end.

Figure 5:
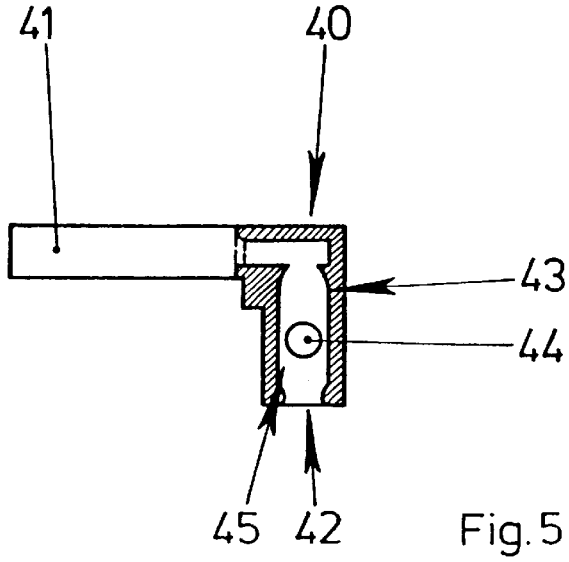
FIG. 5 shows a partially annular element having a channel for the feed device according to the invention.

FIG. 5 shows a partially annular element 40 which can be used in the feed device 31 from FIG. 4 instead of the annular element 34. The partially annular element 40 has clamping arms 41 with which it can be securely clamped in the annular groove 37 (illustrated in FIG. 4) of the housing 33 of the electric motor 3. A valve 45 which is controlled by a float 44 is arranged in a channel 43 of the partially annular element 40, which channel is guided up to an opening 42. The valve 45 has the same function as that described in FIG. 3.

Figure 6:
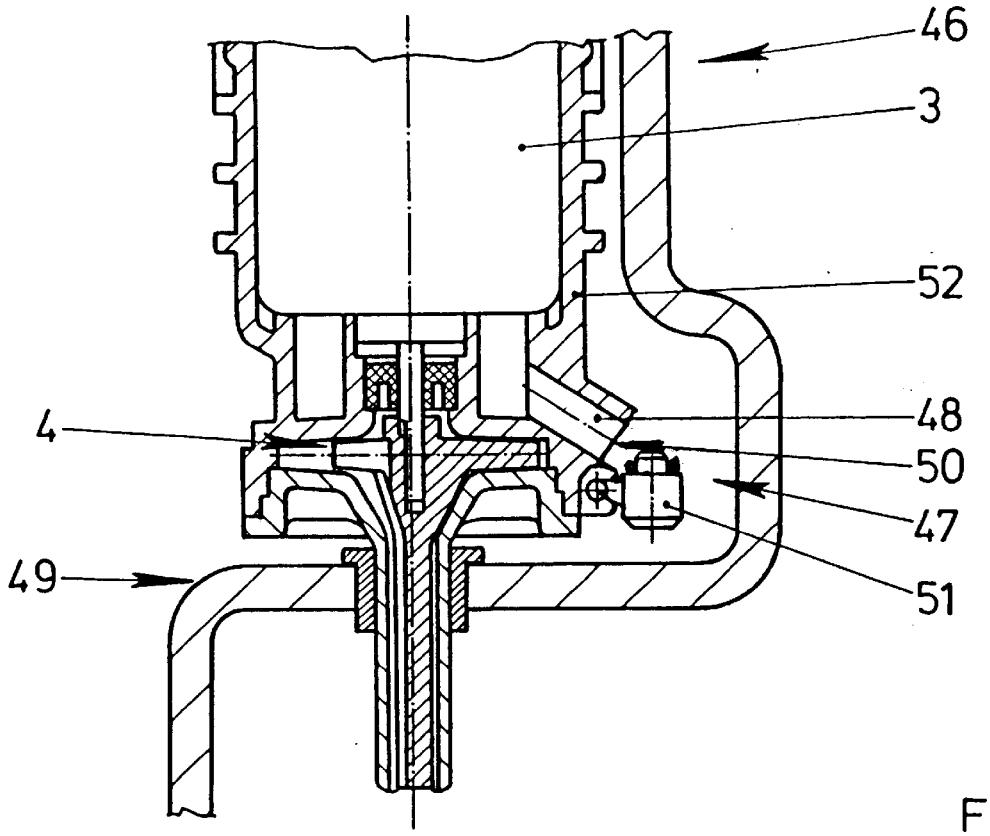
FIG. 6 shows a feed device according to the invention which is fitted on a reservoir.

FIG. 6 shows the lower region of a feed device 46 having a channel 48 which can be closed by a valve 47. The valve 47 has a pivotable float 51 designed as the valve body and an opening 50 of the channel 48, which opening is designed as the valve seat. Furthermore, a region of a reservoir 49 which is adjacent to the feed device 46 is illustrated. It can be seen here that the valve 47 is arranged in a niche of the reservoir 49 and is therefore largely protected from damage. As in the embodiment according to FIG. 1, the channel 48 is arranged in a housing 52 of the electric motor 3 and is guided until level with the feed pump 4. The valve 47 is situated here in the open position in which the electric motor 3 is ventilated. At a sufficient water level, the float 51 pivots against the opening 50 and closes the channel 48. The float 51 bears an O-ring or a similar sealing arrangement in order to provide a reliable seal on its side facing the opening 50.

Figure 7:
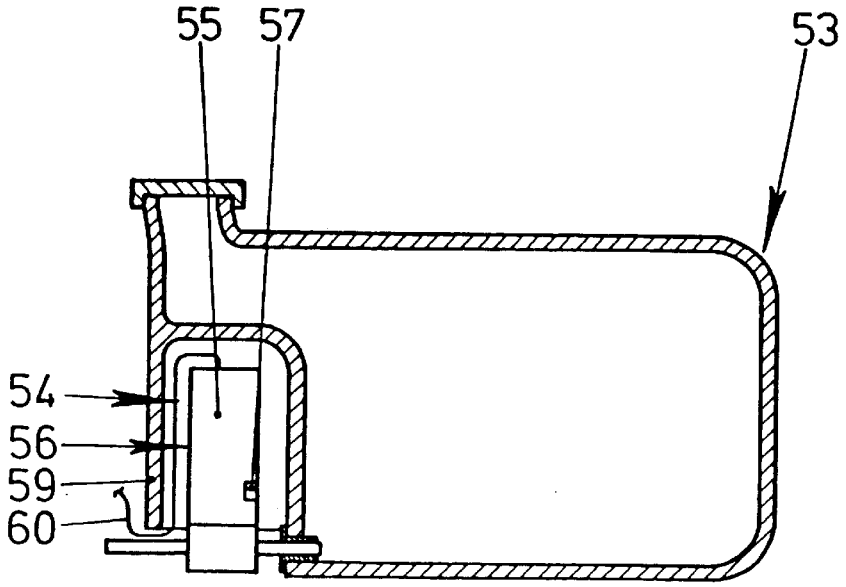
FIG. 7 shows a longitudinal section through a reservoir according to the invention with a feed device fastened on it.

FIG. 7 shows a reservoir 53 having a feed device 54. A housing 55 of an electric motor 56 of the feed device 54 has a recess 57 in order to ventilate it. The reservoir 53 has an edge 59 guided over the feed device 54 until level with a feed pump 58 arranged below the electric motor 56. At a sufficiently high water level, an air bubble is formed below the edge 59, and therefore in the region of the electric motor 56. Water is therefore prevented from penetrating through the recess 57 into the electric motor 56. Electric lines 60 for supplying the electric motor 56 with electric current are passed through here below the edge 59. In the event of corresponding sealing, the lines 60 may also be passed through the edge 59.

I claim:

1. A feed device for a motor vehicle for feeding washer fluid from a reservoir to a washer jet arranged in front of a window or lens, comprising a feed pump which is driven by an electric motor and having a ventilating means for the electric motor, and means for forming an air bubble within the electric motor (3) in the event of a water level reaching the electric motor (3) positioned in a designated installation position.

2. The feed device as claimed in claim 1, wherein the ventilating means has an opening (11, 18, 25, 36, 42, 50) which points downward in the designated installation position of the electric motor (3), and wherein a housing (6, 16, 23, 33, 52) is formed such that it is hermetically sealed in an upper region.

3. The feed device as claimed in claim 2, wherein the housing (6, 52) of the electric motor (3) has a channel (10, 48) connected to the opening (11, 50).

4. The feed device as claimed in claim 2, wherein the opening (11, 18, 25, 36, 42, 50) is arranged on a side of the electric motor (3) such that said opening faces reservoir (2, 49).

5. The feed device as claimed in claim 2, wherein an opening (25, 42, 50) is closeable by a valve (27, 45, 47) and; wherein means for forming an air bubble includes designated cross-section sized channels in a remaining region of said housing (7, 21, 29).

6. The feed device as claimed in claim 1, wherein a lower edge of a cap (15) arranged on an upper side of the electric motor (3) is arranged level with an opening (18).

7. The feed device as claimed in claim 6, wherein the cap (15) forms a subregion of the opening (18).

8. The feed device as claimed in claim 1, wherein a recess (20) is arranged in a housing (16) of the electric motor (3) on an opposite side of an opening (18), and the recess (20) and the pening (18) are connected to each other via an annular groove (19).

9. The feed device as claimed in claim 1, wherein a cap (7, 29, 38) is sealed with respect to a housing (6, 23, 33) of the electric motor (3).

10. The feed device as claimed in claim 1, wherein contacts (8) which are arranged on an upper side of the electric motor (3) and are provided for connection of electric lines are sealed with respect to a cap (7, 15, 29, 38) or a housing (6, 16, 23, 33).

11. The feed device as claimed in claim 1, wherein a cap (7, 15) has a seal (9, 21) made of an elastomeric material, and the seal (9, 21, 30) seals against electrical motor contacts (8).

12. The feed device as claimed in claim 1, wherein a recess (32), provided for ventilation purposes, is located in a housing (33) and connected in a sealing manner to an elastic, annular element (34), said element having a channel (35, 43) with an opening (36, 42).

13. The feed device as claimed in claim 12, wherein the annular element (34) covers an annular groove (37) which is arranged on an outside of the housing (33) of the electric motor (3) in a region of the recess (32) provided for ventilation purposes, and the channel (35) is connected to the annular groove (37).

14. The feed device as claimed in claim 12, wherein the channel (35, 48) is inclined by a designated angle with respect to an axis of symmetry of the electric motor (3).

15. The feed device as claimed in claim 12, wherein the channel (35) has an encircling collar (39) located on a free end.

16. The feed device as claimed in claim 1, further comprising a valve (27, 45, 47) controlled by a float (28, 44, 51) is arranged on an opening (50) or in a channel (26, 43) connected to an opening (25, 42).

17. The feed device as claimed in claim 1; further comprising a housing (24), arranged below the electric motor (3); wherein said housing has a subregion forming a channel (26) connected to an opening (25).

18. The feed device as claimed in claim 1, wherein a valve body of a float valve (45) is mounted pivotably.

19. The feed device as claimed in claim 1, wherein the reservoir (49) has an edge (59) which fits over the electric motor (56) and extends at least to a lower side of a motor housing (55).

* * * * *